US008771007B2

(12) United States Patent
Reibke et al.

(10) Patent No.: US 8,771,007 B2
(45) Date of Patent: Jul. 8, 2014

(54) SYSTEM FOR CONNECTING ELECTRIC CONDUCTORS WITH POTENTIALS WHICH DIFFER FROM ONE ANOTHER AND PLUG-IN ADAPTER FOR THE SYSTEM

(75) Inventors: Heinz Reibke, Bad Salzuflen (DE); Bernd Wilinski, Lemgo (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 194 days.

(21) Appl. No.: 13/503,475

(22) PCT Filed: Oct. 20, 2010

(86) PCT No.: PCT/EP2010/065808

§ 371 (c)(1), (2), (4) Date: Jun. 13, 2012

(87) PCT Pub. No.: WO2011/048151

PCT Pub. Date: Apr. 28, 2011

(65) Prior Publication Data

US 2012/0252262 A1 Oct. 4, 2012

(30) Foreign Application Priority Data

Oct. 21, 2009 (DE) ..... 20 2009 014 251 U
Nov. 5, 2009 (DE) ..... 10 2009 052 109

(51) Int. Cl.
*H01R 31/08* (2006.01)

(52) U.S. Cl.
USPC ..... 439/511; 439/189; 439/709

(58) Field of Classification Search
USPC ..... 439/507, 510, 511, 49, 709
See application file for complete search history.

(56) References Cited

U.S. PATENT DOCUMENTS 4,030,793 A * 6/1977 Hanlon et al. ..... 439/189
4,689,718 A * 8/1987 Maue et al. ..... 439/511

(Continued)

FOREIGN PATENT DOCUMENTS

DE 2 116 342 A1 12/1972
DE 43 22 535 A1 1/1995

(Continued)

OTHER PUBLICATIONS

International Search Report for International Application No. PCT/EP2010/065808 Dated Feb. 14, 2011.

*Primary Examiner* — Hien Vu
(74) *Attorney, Agent, or Firm* — Roberts Mlotkowski Safran & Cole, P.C.; David S. Safran

(57) ABSTRACT

The present invention relates to a system for connecting electrical conductors to mutually different potentials, consisting of at least two electrical terminals (10) arranged alongside one another with plug receptacles (12) and at least two plug bridges (14) which have in each case at least two plug contacts (14.2) which are connected to one another via a top web (14.1) and can be plugged into the plug receptacles (12). In order to specify a system for connecting electrical conductors to mutually different potentials in which a high degree of flexibility of the electrical connections is made possible in conjunction with a reduced space requirement, it is proposed that the plug bridges (14) and the electrical terminals (10) are embodied in a manner coordinated with one another in such a way that one plug bridge (14) can be plugged into plug receptacles (12) of the same electrical terminal (10) and the other plug bridge (14) can be plugged crosswise with respect thereto into plug receptacles (12) of two electrical terminals (10) arranged indirectly or directly alongside one another.

12 Claims, 3 Drawing Sheets

(56) References Cited

U.S. PATENT DOCUMENTS

| | | | | |
|---|---|---|---|---|
| 5,071,356 | A * | 12/1991 | Strate et al. | 439/49 |
| 5,669,788 | A * | 9/1997 | Brockman | 439/511 |
| 5,722,862 | A * | 3/1998 | Glathe et al. | 439/709 |
| 8,062,076 | B2 * | 11/2011 | Henke et al. | 439/709 |
| 2010/0039752 | A1 | 2/2010 | Schmidt et al. | |

FOREIGN PATENT DOCUMENTS

| | | | |
|---|---|---|---|
| DE | 10 2008 017 429 | A1 | 10/2008 |
| EP | 1 511 123 | A1 | 3/2005 |
| EP | 2 053 696 | A1 | 4/2009 |

* cited by examiner

SYSTEM FOR CONNECTING ELECTRIC CONDUCTORS WITH POTENTIALS WHICH DIFFER FROM ONE ANOTHER AND PLUG-IN ADAPTER FOR THE SYSTEM

BACKGROUND OF THE INVENTION

1. Field of the Invention

This invention relates to a system for connecting electric conductors with potentials which differ from one another that is comprised of at least two electrical terminals which are located next to one another with plug-in receptacles and at least two plug-in jumpers which each have at least two plug-in contacts which are connected to one another via a head web and which can be inserted into the plug-in receptacles.

2. Description of Related Art

A system of the type to which the present invention is directed is known, for example, from German Patent DE 43 22 535 C2. The known system for connection of electrical conductors with potentials which differ from one another is comprised of at least two electrical terminals which are located next to one another with plug-in receptacles and at least two plug-in jumpers which each have at least two plug-in contacts which are connected to one another via a head web and which can be inserted into the plug-in receptacles.

Moreover, German Patent Application DE 10 2008 017 429 A1 and the corresponding U.S. Patent Application Publication US 2010/039752 A1 disclose an electrical switchgear unit in which, to reduce the wiring cost among others, a so-called integral or coding plug is used. In order to enable flexible wiring, accordingly, different integral or coding plugs must be retained in which the individual wiring is to be implemented by contact pins which are electrically connected to one another depending on the application. For this purpose, contact bridges are plugged on one terminal side of the integral or coding plug.

SUMMARY OF THE INVENTION

A primary object of this invention is to devise a system for connection of electrical conductors with potentials which differ from one another in which a large measure of flexibility of the electrical connections is enabled with simultaneously reduced space requirements.

This object is achieved by a system and with a plug-in adapter as described herein.

One important advantage of the system in accordance with the invention is especially that as a result of a crossover arrangement of the plug-in jumpers, a large measure of flexibility of the electrical connections is enabled with a simultaneously reduced space requirement.

One especially advantageous development of the system calls for the plug-in jumpers and the electrical terminals to be matched to one another such that the plug-in jumpers can be produced from identical continuous plug-in jumpers. In this way, it is possible to reduce the number of components which are different from one another and to simplify the production and warehousing. For example, it is possible to dimension the distance of the individual plug-in receptacles of the individual electrical terminals relative to one another and relative to the housing of the electrical terminals such that the distance between the individual plug-in receptacles of one electrical terminal and between the plug-in receptacles of two adjacent electrical terminals essentially correspond to one another. Thus, the construction of the plug-in jumper or the continuous plug-in jumper can be matched to this uniform distance so that one type of plug-in jumper and continuous plug-in jumper can be used both for transverse bridgings, therefore for electrical connections of plug-in receptacles of an electrical terminal, as well as for longitudinal bridgings, therefore for electrical connections of plug-in receptacles of electrical terminals located directly or indirectly next to one another.

Depending on the application, the plug-in jumpers can be separated from the continuous plug-in jumpers so that a plurality of existing different individual plug-in jumpers can be produced from a single continuous plug-in jumper. The separation can take place in a manner known to one skilled in the art, for example, by kinking of the continuous plug-in jumper at scored sites or by cutting off. In order to improve the flexibility, it is possible for the plug-in contacts to be made separable in addition for the aforementioned continuous plug-in jumpers.

One other advantageous development calls for at least two plug-in receptacles of at least one of the electrical terminals to be electrically connected in a conductive manner to an electrical contact means of this electrical terminal. This makes it possible to easily connect the two plug-in receptacles with the same electrical potential.

Another advantageous development calls for the number of plug-in receptacles of at least one of the electrical terminals to be selected depending on the number of electrical potentials which are to be connected to the system. In this way, it is possible to tap each of the electrical potentials which are connected to the electrical terminal via plug-in jumpers. It is especially advantageous if the number of plug-in receptacles of all of the electrical terminals used for the system is chosen depending on the number of electrical potentials to be connected to the system, especially when each electrical terminal has at least one, especially two plug-in receptacles per electrical potential.

One especially advantageous development calls for the plug-in contacts of the plug-in jumpers to have a square or a round cross section. This ensures that the expenditure of force for the insertion of the plug-in jumpers into the plug-in receptacles of the electrical terminal is the same size regardless of the plug-in direction of the plug-in jumpers, therefore regardless of whether the plug-in jumper is used for transverse bridging or for longitudinal bridging.

Fundamentally, it is possible for the plug-in jumpers of the system to be inserted directly into the plug-in receptacles of the electrical terminals. It is advantageously provided that, in the mounted state of the system, there is a plug-in adapter between the electrical terminals and the plug-in jumpers.

One advantageous development of the aforementioned embodiment calls for the plug-in jumpers and the plug-in adapter to have catch means which correspond to one another and which, in the mounted state of the system, form a catch connection. In this way, a detachable connection is accomplished with simple means. On the other hand, in this way. a defined alignment of the plug-in jumpers relative to the plug-in adapter is ensured.

Fundamentally, the plug-in adapter can be selected for a system in accordance with the invention according to the type, material, dimensioning and arrangement relative to the remainder of the system in wide, suitable limits. One especially advantageous development calls for the plug-in adapter to have a base plate with a hole pattern which, in the mounted state of the system, is essentially congruent with the plug-in receptacles of the electrical terminals which are located next to one another. In this way, a distinct assignment of the individual holes in the plug-in adapter for inserting the plug-in jumpers to the plug-in receptacles into the electrical terminals of the system is ensured.

In one especially advantageous development, the plug-in adapter is made such that it can be produced from a continuous plug-in adapter. In this way, the production cost is reduced and warehousing is simplified. The plug-in adapters can then be separated from the continuous plug-in adapter depending on the application so that a plurality of individual different plug-in adapters can be produced from a single continuous plug-in adapter. The separation can take place in a manner known to one skilled in the art, for example, by kinking, cracking or bending of the continuous plug-in adapter at scored sites or by cutting off.

One advantageous development of the plug-in adapter calls for it to have first ribs on the side of the base plate which faces the plug-in jumpers in the mounted state of the system, the first ribs running in the direction of the arrangement of the electric terminals located next to one another. On the one hand, the plug-in jumpers during insertion into the plug-in adapter are guided by the first ribs so that the electrical contact between the plug-in contacts and the electrical terminals is ensured when the plug-in contacts of the plug-in jumpers are inserted into the plug-in receptacles. If the plug-in adapter, or at least its first ribs, are produced from an electrical insulating material, in this way, the necessary electrical creepage distance, and thus, the required resistance to creepage of the plug-in adapter can be accomplished especially easily. On the other hand, it is possible that the height of the first ribs from the base plate is chosen such that it defines a pre-established insertion depth of the plug-in contacts into the plug-in receptacles of the electrical terminals.

One especially advantageous development of the aforementioned embodiment calls for the first ribs to encompass two groups of ribs of different height, in the mounted state of the system the higher ribs being located between plug-in receptacles which are electrically connected with potentials which differ from one another and the lower ribs being located between plug-in receptacles which are electrically connected with the same potentials. In this way, on the one hand, the required high resistance to creepage between plug-in receptacles of differing electrical potentials is ensured, and on the other hand, the mounting and dismounting of the individual plug-in jumpers onto and from the plug-in adapters are simplified. For example, the individual plug-in jumpers can be gripped by the lower ribs on their head web by a user. On the other hand, it is possible, in this way, to pull the plug-in jumpers over the head web by means of a screwdriver or the like in a manner known to one skilled in the art. For this purpose, the head webs have, for example, engagement grooves.

Another advantageous development of the plug-in adapter with first ribs calls for it to have second ribs on the side of the base plate facing the electrical terminals in the mounted state of the system, the second ribs running in the direction of the arrangement of the electric terminals located next to one another. If the plug-in adapter, or at least the second ribs, are produced from an electrical insulating material, in this way, the necessary creep strength of the plug-in adapter is further improved.

Fundamentally, it is possible for the plug-in adapter to be placed loosely onto or into a receptacle which is formed by the electrical terminals of the system which are located next to one another and to be held solely by the plug-in jumpers which have been inserted into the plug-in adapter and the plug-in receptacles of the electric terminals. Advantageously, the plug-in adapter, in the mounted state of the system, is detachably fastened to the electrical terminals which are located next to one another by means of a catch connection.

In this way, especially the mounting of the plug-in jumpers on the plug-in adapter, and thus, on the electrical terminals is simplified.

The invention is explained in detail below with reference to the accompanying, roughly schematic, drawings.

DETAILED DESCRIPTION OF THE INVENTION

Figure 1:
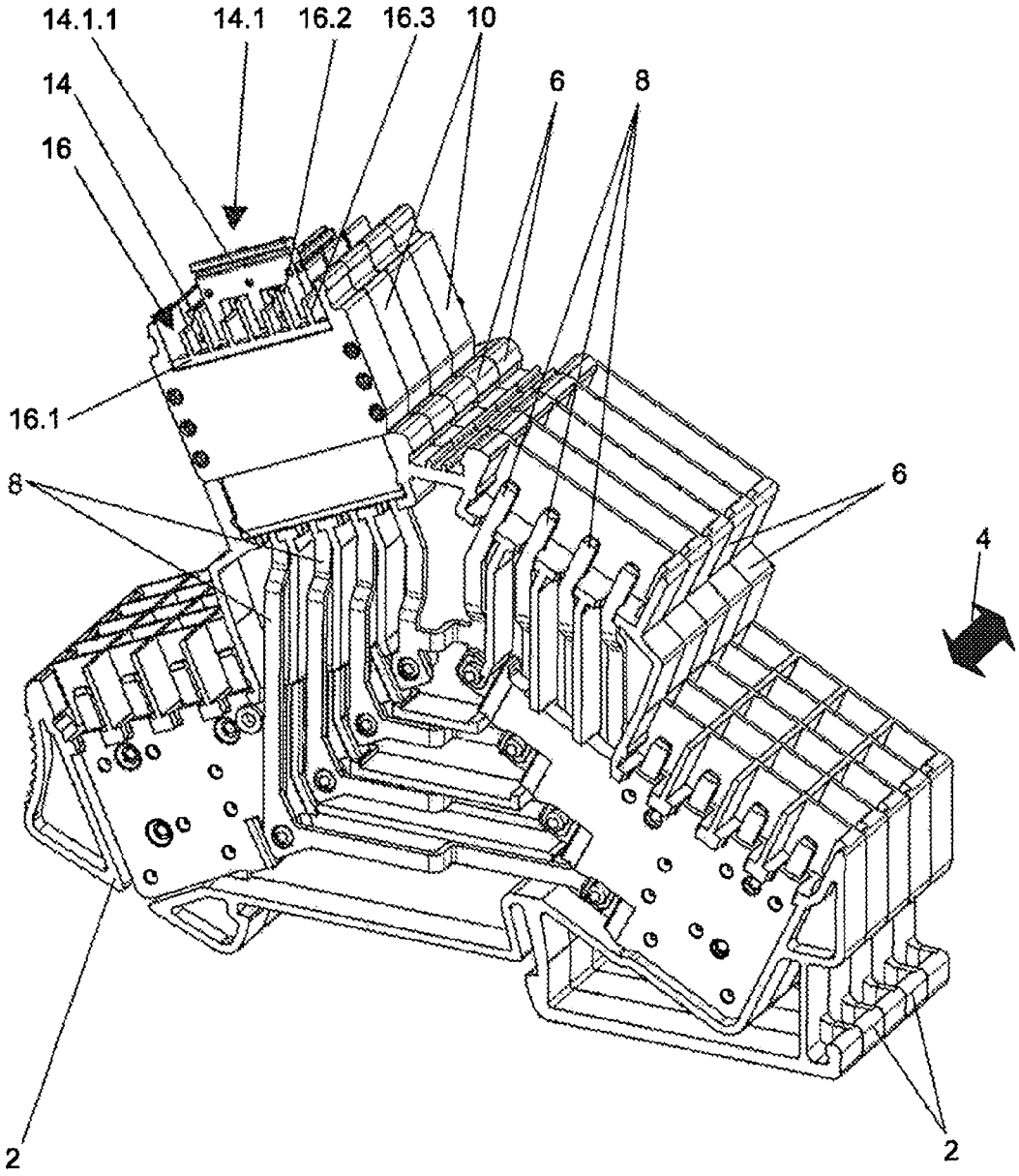
FIG. 1 shows a first exemplary embodiment of the system in accordance with the invention in the mounted state and in a perspective, partially cutaway view.

FIG. 1 shows a first exemplary embodiment of a system in accordance with the invention. The system for connection of electrical conductors with potentials which differ from one another has electrical terminals which are made as base terminals 2 and which are located next to one another here, in this exemplary embodiment, a total of five base terminals 2 being arranged next to one another in the arrangement direction that is represented in FIG. 1 by a double arrow 4. Fundamentally, depending on the application, one skilled in the art is, however, free in the number of base terminals 2 which that can be located next to one another. For this purpose, the base terminals 2 can be slipped in the conventional manner onto a mounting rail (not shown) in the arrangement direction 4 and they each have, among others, two plug-in contact bank assemblies 6. The plug-in contact bank assemblies 6, here, each have four plug-in contacts 8, the plug-in contacts 8 of a plug-in contact bank assembly 6 being occupied with electrical potentials which differ from one another.

Here, electrical terminals made as reconnectable terminals 10 are locked onto four of the base terminals 2 in a manner known to one skilled in the art. As follows from FIG. 1, the reconnectable terminals 10 are located next to one another in the arrangement direction 4. The reconnectable terminals 10, explained below, have plug-in receptacles 12 which are not shown in FIG. 1 and into which plug-in jumpers 14 are inserted.

Here, there is a plug-in adapter 16 between the plug-in jumpers 14 and the reconnectable terminals 10. The plug-in jumpers 14 each have at least two plug-in contacts 14.2 which are connected to one another via a head web 14.1, which can be inserted into the plug-in receptacles 12, and which are detailed in FIG. 2. In the head web 14.1 an engagement groove 14.1.1 is made for easier handing of the plug-in jumper 14.

Figure 2:
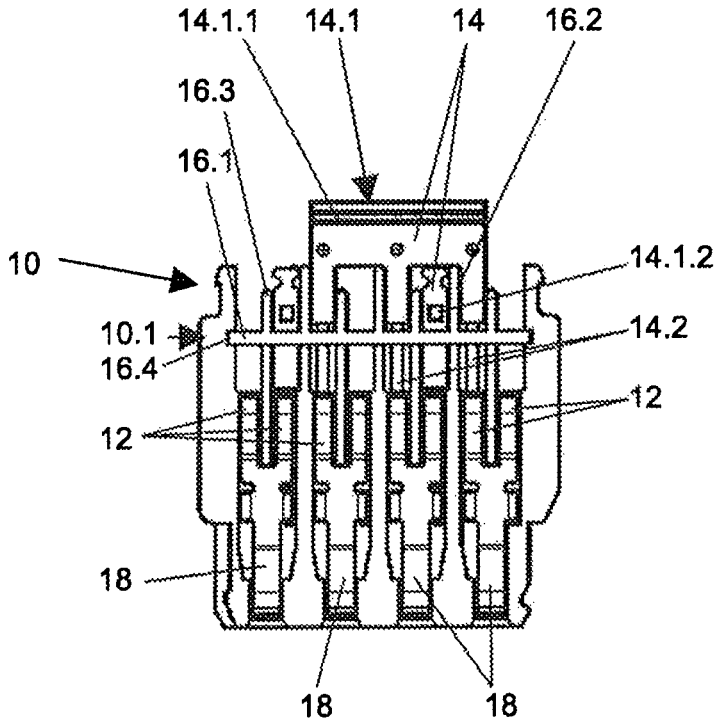
FIG. 2 shows the exemplary embodiment from FIG. 1 in a detail view in the region of the plug-in adapter.

The plug-in jumpers 14 and the reconnectable terminals 10 are made matched to one another such that a plug-in jumper 14 can be inserted into plug-in receptacles 12 of the same reconnectable terminal 10 and the other plug-in jumper 14 can be inserted crosswise into plug-in receptacles 12 of two reconnectable terminals 10 which are located directly or indirectly next to one another; see, FIGS. 1 & 2 in this regard.

As follows from a combined examination of FIGS. 1 & 2, the plug-in jumpers 14 and the reconnectable terminals 10 are matched to one another such that the plug-in jumpers 14 can be produced from identical continuous plug-in jumpers. The continuous plug-in jumper here is formed from an elongated head web on which there are plug-in contacts at regular distances to one another. The head web and the plug-in contacts of the continuous plug-in jumper are formed from an electrically conductive material here which is surrounded with an insulating material, here plastic, in the region of the head web. In this respect, see especially FIG. 2. The continuous plug-in jumper (which is not explicitly shown here) would be made similarly to the plug-in jumper 14 which is shown in FIG. 2, extending in the plane of the page from left to right, and the continuous plug-in jumper, in contrast to the illustrated plug-in jumper 14, would always continue in the same way in the plane of the page to the left and right, as explained above.

As follows form FIG. 2, at least two plug-in receptacles 12 of at least one of the reconnectable terminals 10 are electrically connected conductively to an electrical contact means 18 of this reconnectable terminal 10. As explained above, the reconnectable terminals 10 are slipped onto the base terminals 2 in this exemplary embodiment, each of the electrical contact means 18 becoming electrically connected to the plug-in contacts 8 of the corresponding plug-in contact bank assembly 6. Here, two plug-in receptacles 12 of each reconnectable terminal 10 are electrically conductively connected to a respective one of the electrical contact means 18 via the plug-in contacts 8 with differing electrical potentials.

Thus, the number of plug-in receptacles 12 of at least one of the reconnectable terminals 10 is chosen here depending on the number of electrical potentials which are to be connected to the system, specifically there are two plug-in receptacles 12 per reconnectable terminal 10 per electrical potential.

In order to ensure an expenditure of force for the insertion of the plug-in jumpers 14 which is always the same regardless of the selected type of bridging, therefore longitudinal bridging or transverse bridging, the cross sections of the plug-in contacts 14.2 of the continuous plug-in jumper, and thus of the plug-in jumpers 14 used, are made square here. Alternatively, for example a round cross section would also be usable.

The plug-in adapter 16 of this exemplary embodiment has a base plate 16.1 with a hole pattern so that a type of hole matrix arises in the base plate 16.1. The hole matrix in the mounted state of the system shown in the figures is essentially congruent with the plug-in receptacles 12 of the reconnectable terminals 10 which are located next to one another.

Similar to the manner in which the plug-in jumpers 14 are produced from a continuous plug-in jumper, here, the plug-in adapter 16 used is produced from a continuous plug-in adapter, the continuous plug-in adapter being formed as a longitudinal profile with the cross section of the plug-in adapter 16 which is apparent from FIG. 2. The continuous plug-in adapter can be cut off to the required length according to the respective application. For example, scored sites or the like can be provided for this purpose.

As is furthermore apparent from FIGS. 1 & 2, the plug-in adapter 16 on the side of the base plate 16.1 facing the plug-in jumpers 14 in the mounted state of the system has first ribs 16.2 and 16.3, the first ribs 16.2 and 16.3 running in the arrangement direction 4 of the reconnectable terminals 10 which are located next to one another. The entire plug-in adapter 16, therefore both the base plate 16.1 as well as the first ribs 16.2, 16.3 are produced here from an insulating material, such as, for example, a plastic.

The first ribs 16.2 and 16.3 comprise two groups of ribs of different height in which, in the mounted state of the system, the higher first ribs 16.2 are located between plug-in receptacles 12 which are electrically connected with differing potentials, and the lower first ribs 16.3 are located between plug-in receptacles 12 which are electrically connected with the same potentials. This has the advantage that, on the one hand, sufficient resistance to creepage is implemented. On the other hand, the first ribs 16.2 which are higher relative to the base plate 16.1 provide for a preestablished and defined insertion length of the plug-in contacts 14.2 of the plug-in jumpers 14 used for transverse bridging in the plug-in receptacles 12, since these plug-in jumpers 14 come into contact with the head webs 14.2 on the tops of the higher first ribs 16.2. Moreover, the lower first ribs 16.3 enable simplified mounting and dismounting of the plug-in jumpers 14 which are used for longitudinal bridging. As already explained above, the holding web 14.1 of the plug-in jumpers 14 has an engagement groove 14.1.1. A screwdriver or the like can be inserted into the engagement groove 14.1.1 in order to pull these plug-in jumpers 14 in the manner known to one skilled in the art. Furthermore the engagement groove 14.1.1 facilitates handling of each plug-in jumper 14, regardless of its use and arrangement.

For detachable fixing, the plug-in adapter 16, in the mounted state of the system, is detachably fastened by means of a catch connection to the reconnectable terminals 10 which are located next to one another. For this purpose, catch grooves 10.1 are formed on the reconnectable terminals 10 and catch regions 16.4 are formed on the plug-in adapter 16. See especially FIG. 2 in this respect.

FIGS. 3-6 show a second exemplary embodiment of the system in accordance with the invention with the same or corresponding components being provided with the same reference numbers. Only the differences from the first exemplary embodiment are explained below. Otherwise, with respect to the second exemplary embodiment, reference can be made to the details on the first exemplary embodiment.

Figure 3:
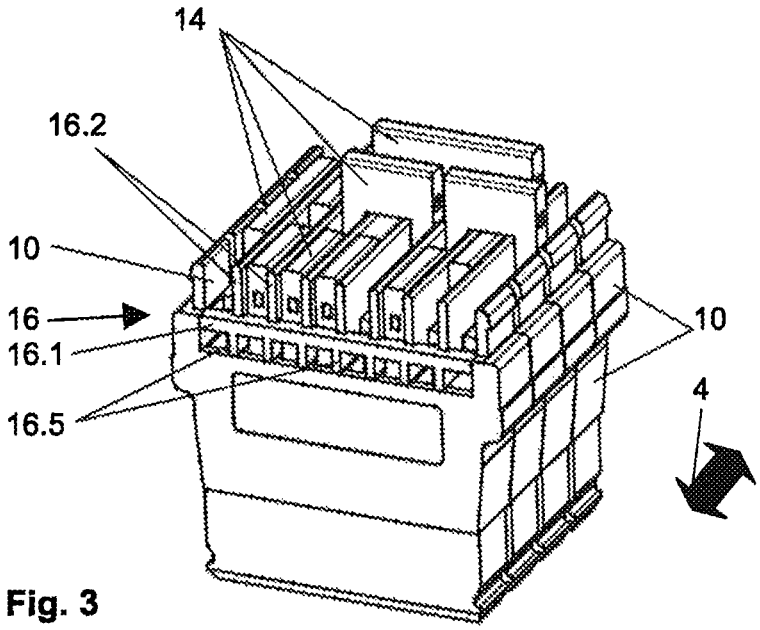
FIG. 3 is a perspective view of second exemplary embodiment of the system in accordance with the invention in the mounted state in the region of the plug-in adapter.
Figure 4:
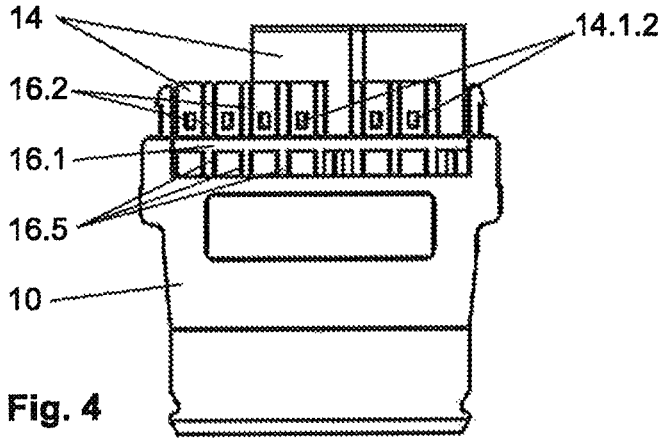
FIG. 4 is a front view of the second exemplary embodiment.

FIG. 3 shows the second exemplary embodiment in a view similar to that of FIG. 1 for the first exemplary embodiment. For purposes of improved clarity, the base terminals 2 have been omitted in FIG. 3. As clearly follows from FIG. 3, a major difference from the first exemplary embodiment lies in that the plug-in adapter 16, here, has second ribs 16.5 on the opposite side of the base plate 16.1 from the first ribs 16.2 in the illustrated mounted state of the system, the second ribs 16.5 running in the arrangement direction 4 of the reconnectable terminals 10. This further improves the resistance to creepage. All of the second ribs 16.5 extend the same distance in the direction of the reconnectable terminal 10 relative to the base plate 16.1.

A further difference is that there are only first ribs 16.2 in this exemplary embodiment, there being no shorter ribs 16.3. Moreover, the plug-in adapter 16 here rests simply in one receptacle farmed by the reconnectable terminals 10 which are located next to one another and is not detachably held on it via a catch connection. The plug-in adapter 16 is fixed here solely via the plug-in contacts 14.2 of the plug-in jumpers 14, which contacts have been inserted into the plug-in adapter 16 and the plug-in receptacles 12.

Figure 5:
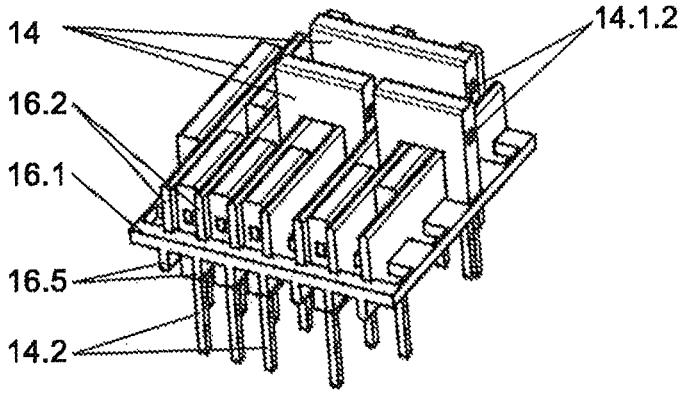
FIG. 5 shows the second exemplary embodiment in a view analogous to that of FIG. 3, but without the electrical terminal.
Figure 6:
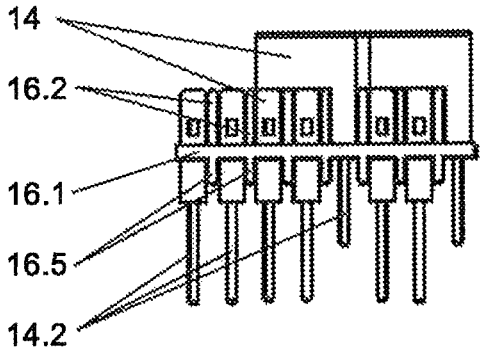
FIG. 6 is a front view of the second exemplary embodiment according to FIG. 5.

As follows especially from FIGS. 3 & 5, in the system in accordance with the invention, it is possible to insert a plurality of plug-in jumpers 14 crosswise via the plug-in adapters 16 into the plug-in receptacles 12 of the reconnectable terminals 10. This applies regardless of the exemplary embodiment. Here, the plug-in jumpers 14 which are used for longitudinal bridging are inserted underneath the plug-in jumpers 14 which are used for transverse bridging into the plug-in adapter 16 and the plug-in receptacles 12. The desired and pre-established insertion depth of the plug-in jumpers 14 which are used for longitudinal bridging can be defined by the thickness of the base plate 16.1 as in the first exemplary embodiment or by the base plate 16.1 in conjunction with the second ribs 16.5 as in the second embodiment.

The figures clearly show how the plug-in jumpers 14 used have been produced from a continuous plug-in jumper. The metal cores 14.1.2 of the head webs 14.1 can be recognized in the figures by cutting off the continuous plug-in jumper into the respective plug-in jumper 14.

The invention is not limited to the explained exemplary embodiments. For example, the system in accordance with the invention can also be advantageously used with other electrical terminals, such as, for example, electrical terminals which are made, for example, as base terminals. The plug-in jumpers 14 and the plug-in adapter 16 can also have catch means which correspond to one another and which form a catch connection in the mounted state of the system. Furthermore, production of the plug-in jumpers and plug-in adapters is not limited to the described production methods. Moreover, the indicated materials, dimensions and arrangements are purely exemplary. Depending on the application, one skilled in the art will use the most suitable production methods, materials, dimensions and arrangements.

Finally, it is pointed out that the described system for connecting electrical conductors, on the one hand, can contain reconnectable terminals 10 and base terminals 2. In this embodiment, the plug-in receptacles 12 and the electrical contact means 18 are a component of the reconnectable terminals 10.

In another alternative embodiment, which is not shown, it can be provided that the plug-in receptacles and the electrical contact means are components of the base terminals. This embodiment has the advantage that reconnectable terminals are not necessary, the system therefore consists of few individual parts and the user need not seat a reconnectable terminal only on the base terminal to establish switching possibilities. Moreover this alternative embodiment of the system has the advantage that the contact resistances between the plug-in contacts and the electrical contact means assigned which are to them are much smaller than if the user connects the electrical contact means to the plug-in contacts. This is especially due to the fact that the plug-in receptacles and the electrical contact means are already electrically connected in the base terminal. When using the base terminal in a harsh environment, this prevents the possibility of formation of foreign materials, such as dust, soot or the like, on the plug-in contacts or the electrical contact means, which can prevent good electrical contact between the plug-in contacts and the electrical contact means. An especially low contact resistance is achieved in the alternative version of the system when the plug-in contact and the electrical contact means which corresponds thereto are made in one piece because then there are no contact sites between the plug-in contact and the electrical contact means. This reduces the contact resistances in the system.

What is claimed is:

1. A system for connection of electrical conductors with potentials which differ from one another, comprising:

at least two electrical terminals which are located next to one another with plug-in receptacles and at least two plug-in jumpers, each of which has at least two plug-in contacts which are connected to one another via a head web and are insertable into the plug-in receptacles, wherein the plug-in jumpers and the electrical terminals are matched to one another such that one of the at least two plug-in jumpers is insertable into any of the plug-in receptacles of a first of the at least two electrical terminals and another of the at least two plug-in jumpers is insertable into any of the plug-in receptacles of a second of the at least two electrical terminals, the first and second of the at least two electrical terminals being located directly or indirectly next to one another in a direction crosswise to a lengthwise direction of the at least two electrical terminals, wherein the plug-in jumpers and the electrical terminals are made matched to one another such that a distance of individual plug-in receptacles of the electrical terminals relative to one another and relative to a housing of the electrical terminals is essentially matched to a distance between individual plug-in receptacles of the second of the electrical terminals, wherein the plug-in jumpers are insertable into one of the electrical terminals in said lengthwise direction and are also insertable into at least two of the electrical terminals in the direction crosswise to said lengthwise direction, the lengthwise direction is substantially perpendicular to the crosswise direction and wherein the plug-in jumpers are detachable parts of a continuous plug-in jumper.

2. The system as claimed in claim 1, wherein at least two plug-in receptacles of at least one of the electrical terminals are electrically connected in a conductive manner to an electrical contact means of the matched electrical terminal.

3. The system as claimed in claim 1, wherein the number of plug-in receptacles of at least one of the electrical terminals is selected depending on the number of electrical potentials which are to be connected to the system.

4. The system as claimed in claim 1, wherein the plug-in contacts of the plug-in jumpers have a square or a round cross section.

5. The system as claimed in claim 1, further comprising a plug-in adapter, the plug-in adapter being adapted to be disposed between the electrical terminals and the plug-in jumpers in a mounted state of the system.

6. The system as claimed in claim 5, wherein the plug-in jumpers and the plug-in adapter have catch means which correspond to one another and which form a catch connection in the mounted state of the system.

7. The system as claimed in claim 5, A plug-in adapter for a system as claimed in claim wherein the plug-in adapter has a base plate with a hole pattern, the hole pattern being essentially congruent with the plug-in receptacles of the electrical terminals.

8. The system as claimed in claim 7, wherein the plug-in adapter is detachable parts of a continuous plug-in adapter.

9. The system as claimed in claim 7, wherein a base plate side of the plug-in adapter is adapted to face the plug-in jumpers in the mounted state of the system has first ribs, the first ribs running in an arrangement direction of the electrical terminals which are located next to one another.

10. The system as claimed in claim 9, wherein the first ribs comprise two groups of ribs of different height, the higher of said ribs being adapted to be located between plug-in receptacles which are electrically connected with potentials which differ from one another in the mounted state of the system, and the lower ribs of said ribs adapted to be located between plug-in receptacles which are electrically connected with the same potentials in the mounted state of the system.

11. The system as claimed in claim 9, wherein the base plate side of the plug-in adapter has second ribs, the second ribs running in said arrangement direction of the electrical terminals.

12. The system as claimed in claim 7, wherein the plug-in adapter is detachably adapted to be detachably fastened to the electrical terminals by a catch connection.

* * * * *